US005452530A

United States Patent [19]

Cartabbia

[11] Patent Number: 5,452,530

[45] Date of Patent: Sep. 26, 1995

[54] PRESSER WITH MOVABLE SECTIONAL PLATEN AND FABRIC SUPPORT

[76] Inventor: Giovanni Cartabbia, Via Piantada, 9/D, 25036 - Palazzolo Sull'Oglio (Brescia), Italy

[21] Appl. No.: 227,794

[22] Filed: Apr. 14, 1994

[30] Foreign Application Priority Data

May 4, 1993 [IT] Italy ..... MI93A0887

[51] Int. Cl.[6] ..... D06F 71/40; D06F 71/38

[52] U.S. Cl. ..... 38/12; 38/20

[58] Field of Search ..... 38/4, 9, 12, 19–24, 38/108; 100/193, 199, 200

[56] References Cited

U.S. PATENT DOCUMENTS

| | | | |
|---|---|---|---|
| 1,835,254 | 12/1931 | Winnewisser | 38/12 |
| 1,876,602 | 9/1932 | Braun | 38/12 X |
| 1,908,111 | 5/1933 | Brockett | 38/12 |
| 1,908,151 | 5/1933 | Jacker | 38/12 |
| 2,013,210 | 9/1935 | Heindenfelder | 38/12 |
| 2,025,058 | 12/1935 | Johnson | 38/20 |
| 5,014,453 | 5/1991 | Gratsch | 38/20 |

*Primary Examiner*—Clifford D. Crowder
*Assistant Examiner*—Ismael Izaguirre
*Attorney, Agent, or Firm*—Bucknam and Archer

[57] ABSTRACT

An improved device for ironing cloth articles having different thicknesses, comprises a bottom ironing panel thereon there is movably supported a pivot member for supporting a resilient sheet element, and a driving cylinder for causing the pivot member to swing about a horizontal axis and a further driving cylinder for driving the pivot member along a direction substantially perpendicular to the ironing panel.

1 Claim, 5 Drawing Sheets

PRESSER WITH MOVABLE SECTIONAL PLATEN AND FABRIC SUPPORT

BACKGROUND OF THE INVENTION

The present invention relates to an improved device for ironing cloth articles having different thicknesses.

As is known, for ironing different thickness cloth articles there are conventionally used ironing apparatus which are provided with a bottom ironing panel on which there is coupled a top ironing panel.

For properly locating the cloth article to be ironed on the bottom ironing panel there is used a frame, the so-called pivot, which partially turns or swings about a substantially horizontal axis in order to define an angular path of movement so as to engage the cloth article to be ironed located on the ironing panel and properly hold it in position.

Prior art devices or methods for tensioning the resilient sheet element supported by the pivot by causing the latter to swing, have not been found to operate satisfactorily, since mutual displacements occur during the tensioning operations.

SUMMERY OF THE INVENTION

Accordingly, the aim of the present invention is to overcome the above mentioned drawbacks by providing an improved device for ironing cloth articles having different thicknesses, which allows to easily perfectly locate of the cloth article on the bottom ironing panel or template as well as firmly hold it during the ironing process.

Within the scope of the above mentioned aim, a main object of the present invention is to provide such a device which is adapted to evenly spread the cloth article to be ironed and efficiently affect the ironing process, in combination with the ironing panels or templates and the apparatus therewith it is associated.

Another object of the present invention is to provide such an ironing device which allows to also tension two fabric layer cloth articles, such as, for example, trousers, the tensioning operation being adapted to be performed on both the fabric layers, that is on the bottom fabric layer and on the top fabric layer.

Yet another object of the present invention is to provide such an improved device for ironing different thickness cloth articles which, owing to its constructional features is very reliable and safe in operation.

Yet another object of the present invention is to provide such an improved device for ironing different thickness cloth articles which can be easily applied to already existing ironing machines and which, furthermore is very competitive from a mere economic standpoint.

According to one aspect of the present invention, the above mentioned aim and objects, as well as yet other objects which will become more apparent hereinafter, are achieved by an improved device for ironing cloth articles having different thicknesses, comprising a bottom ironing panel, thereon a pivot is movably arranged for supporting a resilient sheet element, characterized in that said device further comprises means for causing said pivot to swing about a substantially horizontal axis and driving means for driving said pivot in a direction substantially perpendicular to said ironing panel.

BRIEF DESCRIPTION OF THE DRAWINGS

Further characteristics and advantages of the present invention will become more apparent hereinafter from the following detailed disclosure of a preferred, though not exclusive, embodiment of an improved device for ironing cloth articles having different thicknesses, which is illustrated, by way of an indicative but not limitative example, in the figures of the accompanying drawings, where.

DESCRIPTION OF THE PREFERRED EMBODIMENT

Figure 1:
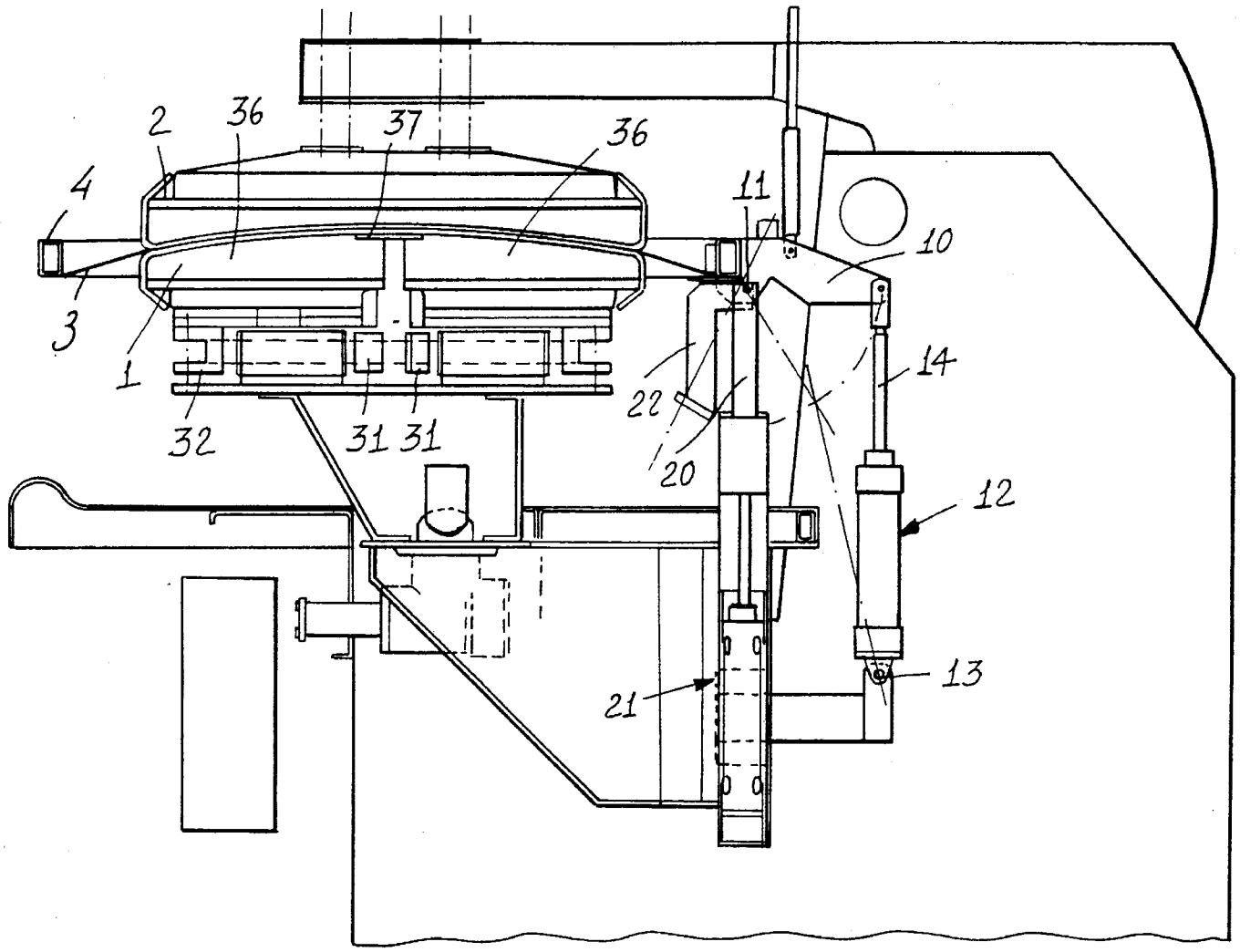
FIG. 1 is a schematic view illustrating the ironing device according to the present invention as applied to an ironing machine.

With reference to the number references of the figures of the accompanying drawings, the improved ironing device for ironing different thickness cloth articles according to the present invention, comprises a bottom ironing panel, indicated generally at the reference number 1, thereon there is arranged, in a per se known manner, a top ironing panel 2.

Between the bottom ironing panel 1 and the top ironing panel 2 there is arranged a resilient sheet element 3, which is supported by a so-called pivot 4, including a frame having a substantially rectangular configuration, projecting from the mentioned bottom ironing panel.

As shown, the pivot 4 is supported by an arm 10 which is articulated,at an intermediate portion thereof, at 11, and which at the free end thereof, is coupled to a swinging cylinder 12, in turn pivoted at 13 to the frame of the ironing machine and which is provided with a stem 14, for swingably driving the pivot.

The arm 10 of the pivot is articulated to the end of a driving or displacement stem 20 of a driving cylinder 21 which allows the pivot to be displaced in parallel to itself.

Moreover, rigid with the stem 20 there is provided a side lug 22 to one end of which there is connected a spring 25 which is also connected to a middle portion of the arm 10.

Figure 2:
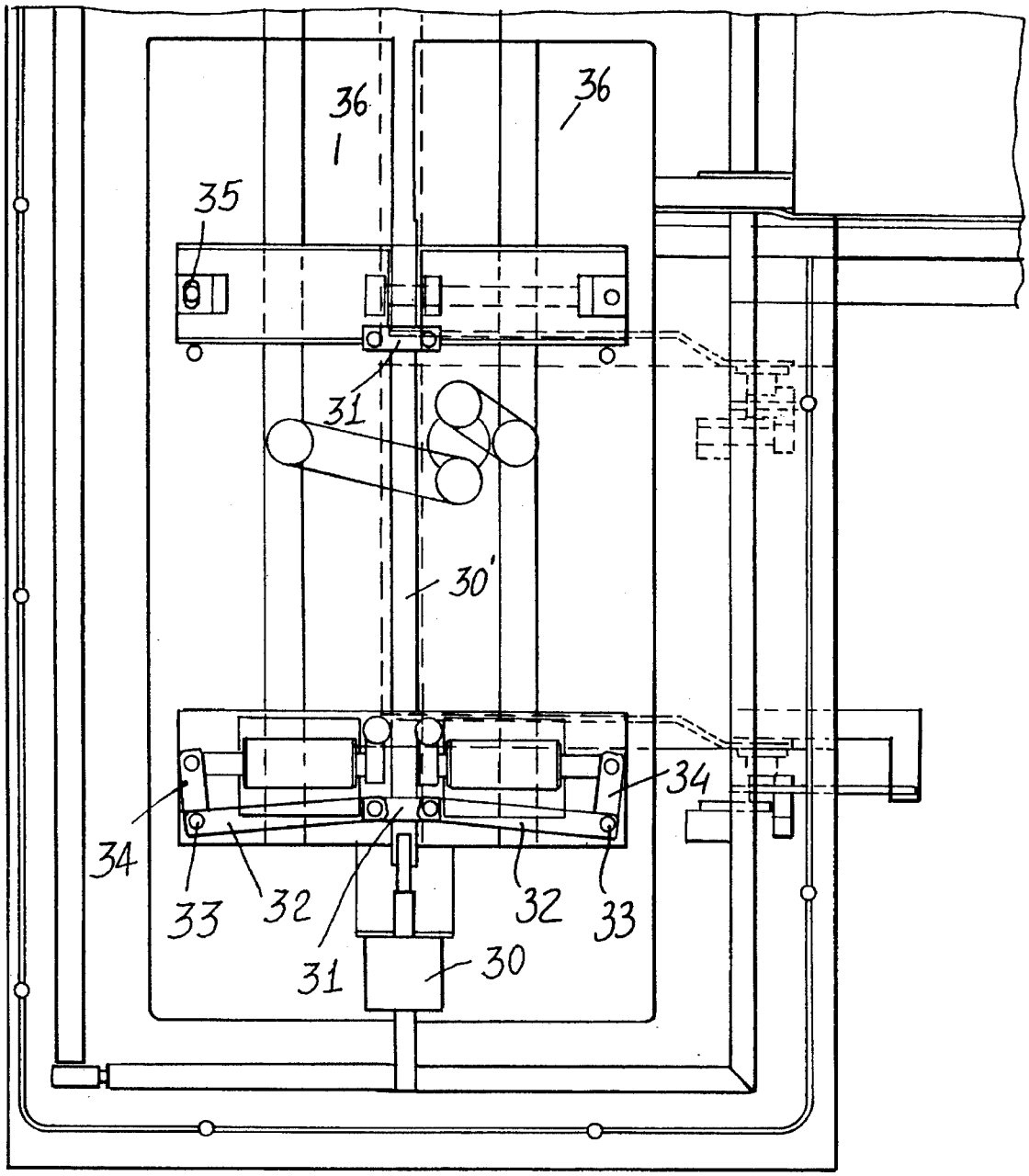
FIG. 2 is a further schematic view illustrating the bottom ironing panel with means for spreading apart it.

In this connection it should be pointed out that, in the case in which two-layer cloth articles are to be ironed, such as trousers or the like, the bottom ironing panel will be provided with cloth article spreading means which have been clearly illustrated in FIG. 2, comprising a spreading piston 30 connected to the stem or rod 30', which supports small blocks 31, pivoted to respective end portions of angle levers 32, in turn articulated at a middle, portion 33 thereof and having an actuating arm 34 engaging in elongated slots 35 associated with the half-elements 36 forming the ironing bottom panel 1.

Between the mentioned half-elements 36 there is provided a continuity strip 37 adapted to hold the continuity of the top surface, as the two half-elements are spread apart in order to in turn spread apart a cloth article to be ironed having a fabric double layer.

In actual practice, in the case of single fabric layer cloth articles, such as, for example, skirts, the pivot will operate according to a conventional manner and the fabric will be spread as a single layer by causing the pivot to be properly displaced.

In the case in which a double fabric layer must be ironed, the operation of the pivot will be combined with the spreading of the bottom ironing panel 1.

Figure 3:
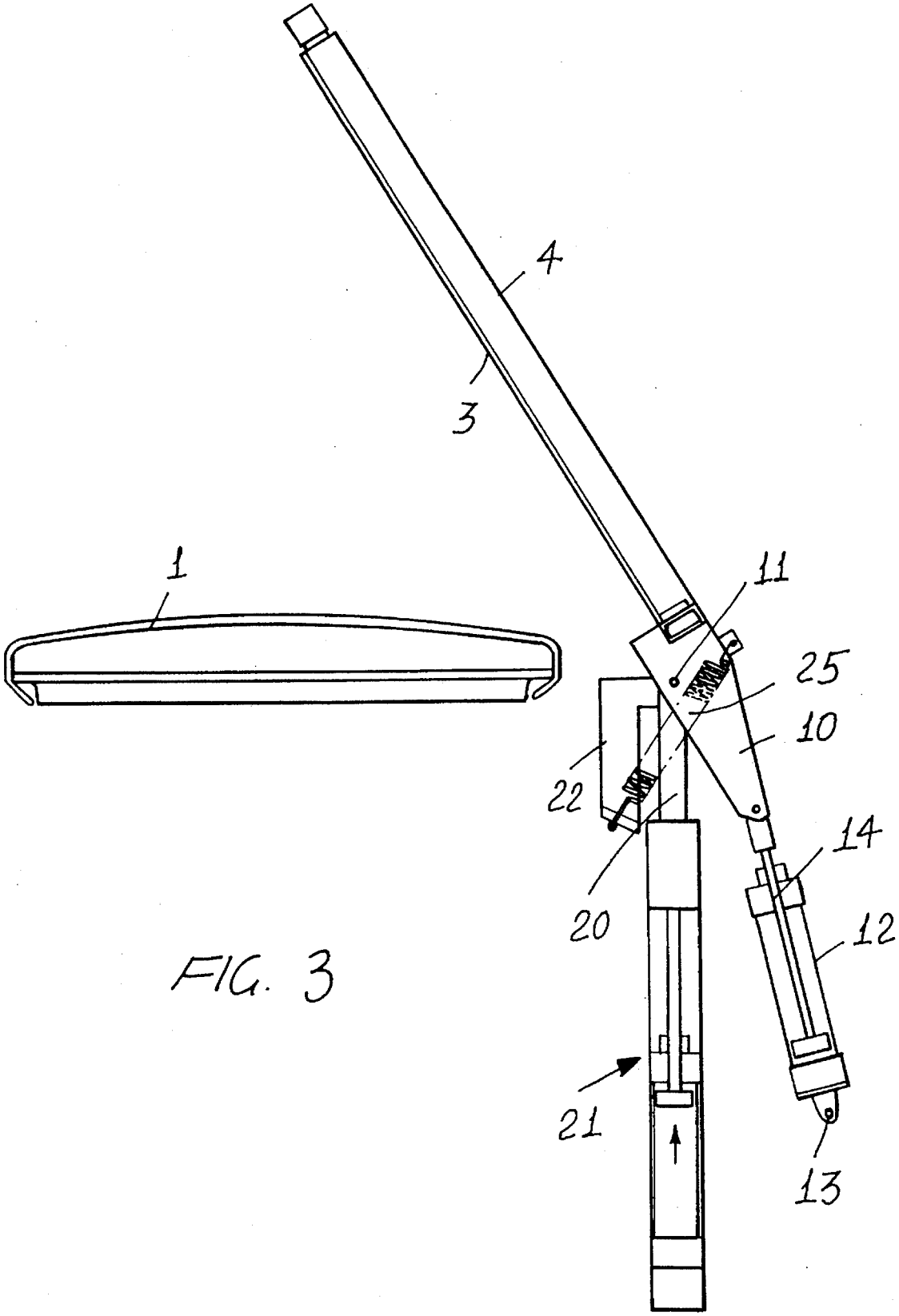
FIG. 3 is a further schematic view illustrating the ironing device in its starting position, with the pivot in a raised condition, in order to allow a cloth article to be ironed to be properly located.

In operation, at the start the improved ironing device according to the present invention will be arranged at a rest position, as is shown in FIG. 3, and the pivot will be arranged in an opening position, with the stem 20 in a raised position. During this operating step, the cloth article to be ironed will be arranged on the bottom ironing panel 1.

Figure 4:
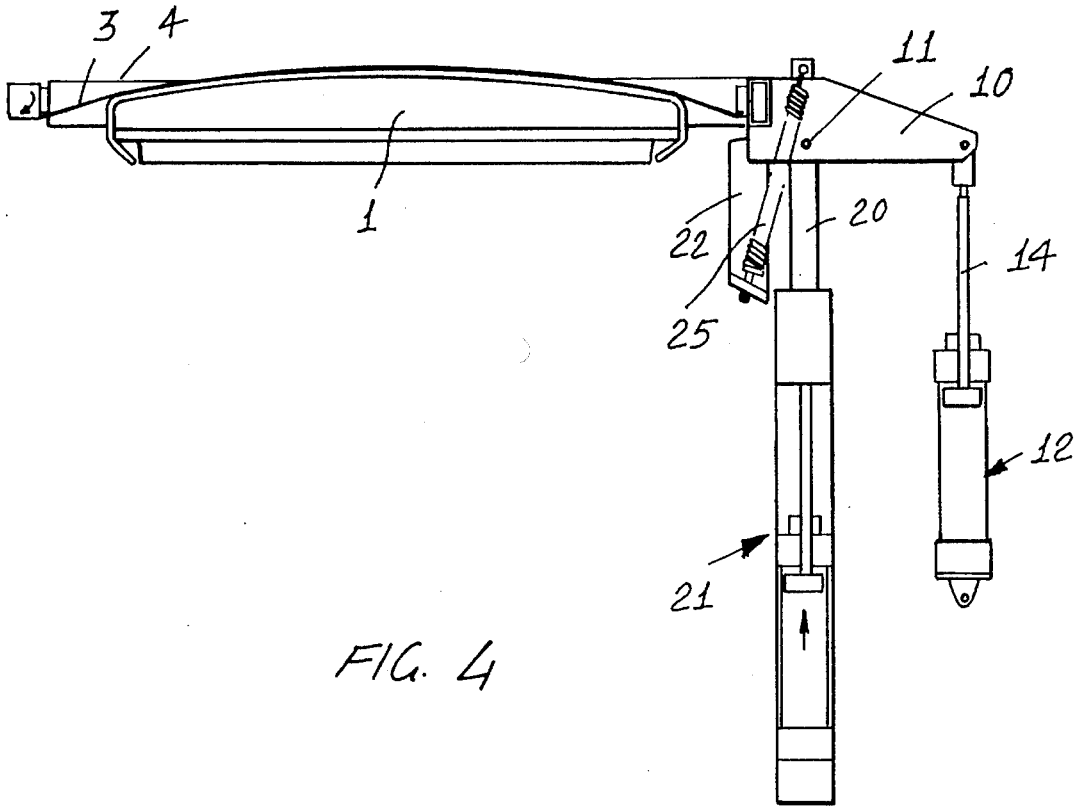
FIG. 4 illustrates the pivot horizontally arranged on the ironing panel.

In a second operating step as is shown in FIG. 4, the pivot will be manually brought to a horizontal position and the closing operation will be performed by the spring 25.

Under these conditions, the driving stem 20 will be held at a top end of stroke position, whereas the stem of the rotating cylinder 12 will be withdrawn by the rotary movement of the pivot under these conditions, the cylinder is not power supplied.

Figure 5:
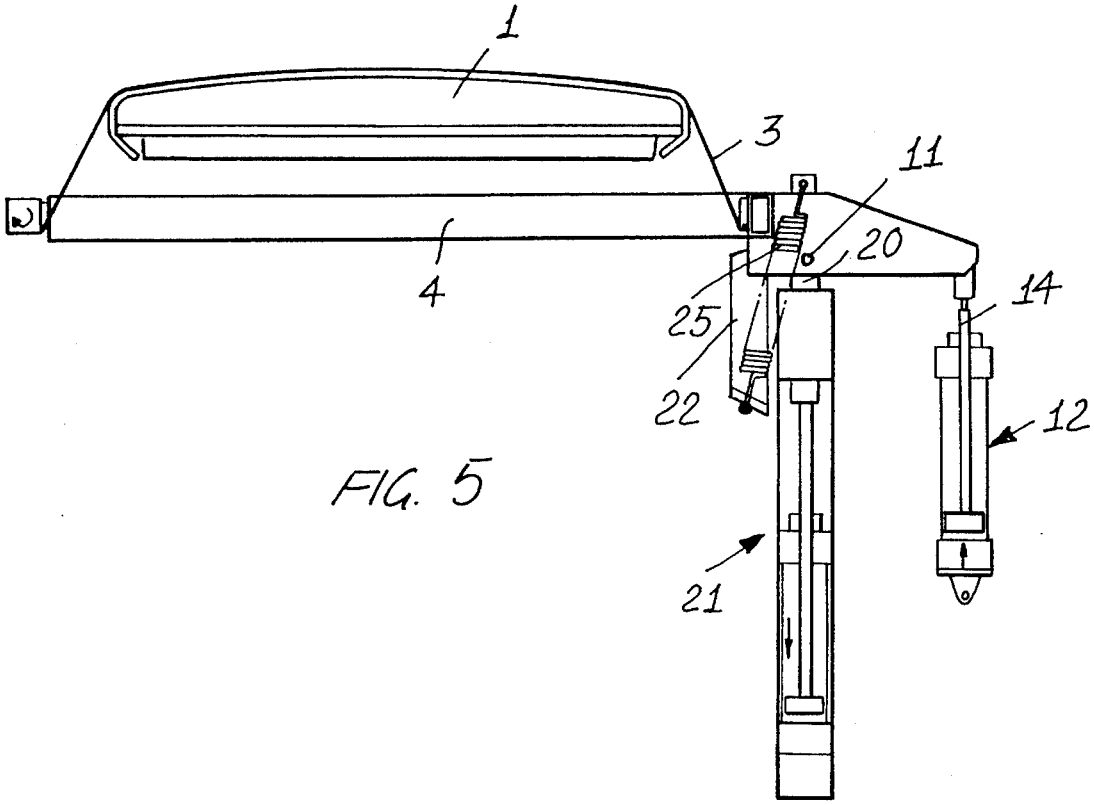
FIG. 5 illustrates a tensioning step applied to the sheet element of the pivot.

Then, in a third operating step, as is shown in FIG. 5, the driving stem 20 will be downwardly driven and a pressure will be applied under the stem 14 in order to cause the pivot 4 to be held in a horizontal position.

During this third operating step the sheet will be spread on the ironing panel, by exerting an elastic or resilient pressure on the bottom ironing panel and, accordingly, on the cloth article arranged thereon.

During this third operating step, the driving cylinder will be supplied with pressurized air, so as to downwardly move, with an adjustable movement amplitude, whereas the rotating cylinder will be supplied at its bottom portion in order to balance the movement of the first cylinder thereby providing a perfectly horizontal position for the pivot.

Figure 6:
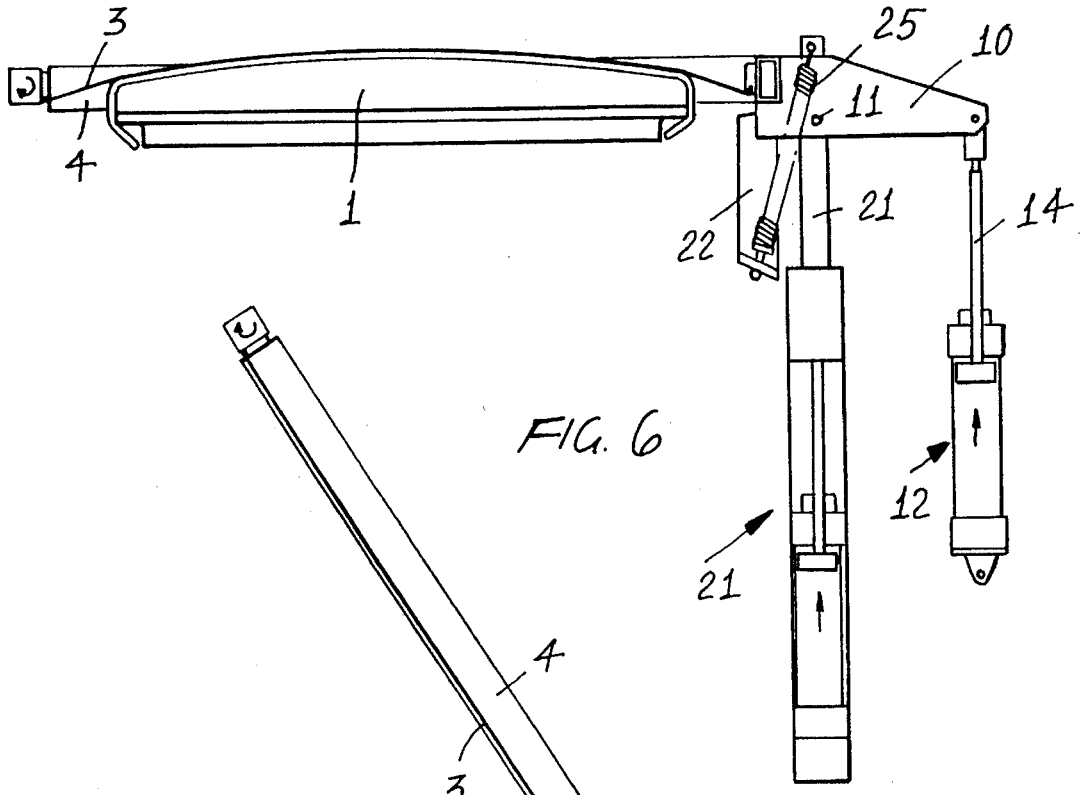
FIG. 6 illustrates a re-rising operation of the pivot, after the ironing process.

During a fourth operating step, which is illustrated in FIG. 6, the pivot is returned to its horizontal resting position and a pressurized fluid will be supplied to the driving cylinder to provide a raising movement as well as to the rotating cylinder, which will be supplied at the bottom thereof, so as to hold a horizontal position.

Figure 7:
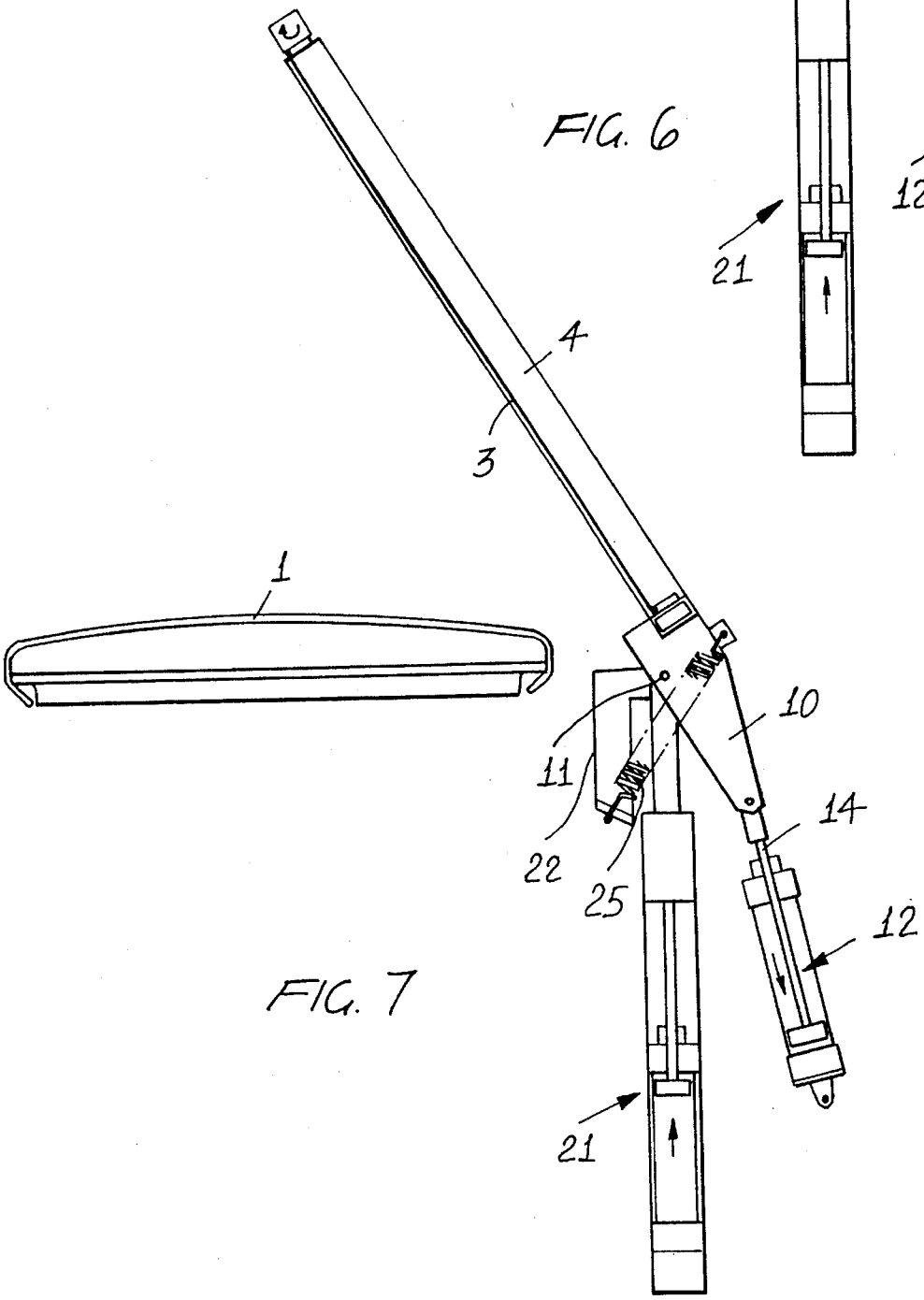
FIG. 7 illustrates an end operating step of opening of the pivot.

In this operating step, the two driving and rotating cylinders will reach their top end of stroke positions During the fifth and last operating step, (see FIG. 7), the pivot will be automatically open, under the effect of a pressurized fluid being supplied, in an opposite direction, inside the swinging cylinder, so as to arrive at its opening position, which will be a stable position since the spring 25 will pass the articulation point 11 so as to hold the opening position.

In the case in which a double fabric layer cloth article must be ironed, in addition to the above disclosed operating steps, there is also performed, during the sheet tensioning step, the bottom ironing panel spreading step.

In particular this step is performed by driving the spreading piston 30 which, by swinging the angle arms, will practically cause the ironing panels to be spread apart.

Then, the pivot will be tensioned and the bottom ironing panel will be spread apart, if required.

During the raising movement of the top ironing panel, moisture will be sucked and then will be performed the automatic raising and opening of the pivot, which preceeds the discharging of the ironed cloth article.

From the above disclosure it should be apparent that the invention fully achieves the intended aim and objects.

In particular, the fact is to be pointed out that an improved ironing device has been provided which allows to simply and easily drive the pivot during the tensioning step, thereby providing a perfect tensioning of the cloth article to be ironed.

The invention, as disclosed, is susceptible to several modifications and variations, all of which will come within the scope of the invention.

Moreover, all of the details can be replaced by other technically equivalent elements.

In practicing the invention, the used materials, as well as the contingent size and shapes, can be any, depending on requirements.

I claim:

1. An ironing device for ironing cloth articles having different thicknesses, comprising a framework supporting a bottom ironing panel made of mutually displaceable half-elements, on said bottom ironing panel a supporting frame being movably arranged for supporting a resilient sheet element, said supporting frame being movable from an open and raised position to a horizontal and closure position, a swinging cylinder having a swinging stem for swinging said supporting frame about a substantially horizontal axis and a driving cylinder having a driving stem driving said supporting frame in a direction substantially perpendicular to said bottom ironing panel, said supporting frame being coupled to an arm articulated at a middle portion thereof and having a free end portion thereof coupled to said stem of said swinging cylinder, articulated to said framework, a side lug rigidly connected to said driving stem, said side lug having a bottom end portion to which there is connected an end of a spring having another end thereof associated with a middle portion of said arm, means for spreading apart said bottom ironing panel, said means comprising a spreading piston coupled to a rod supporting a plurality of blocks pivoted to respective end portions of a plurality of angle levers articulated at a middle portion thereof and connected to said half-elements of said bottom ironing panel, a continuity strip arranged between said half-elements in order to provide continuity to a surface of said bottom ironing panel, as said half-elements are displaced to a spread apart position, wherein said device performs a first operating step with said supporting frame in said open position and set to be manually downwardly displaced, a second operating step with said supporting frame at said closure position and held under tension by a spring in order to allow the cloth article to be arranged in an ironing position and held therein, a third operating step for tensioning said sheet element of said supporting frame, by an opposite pressure of said driving cylinder and swinging cylinder holding said supporting frame at said horizontal position, a fourth operating step in which said supporting frame is returned to said raised position with said cylinders being both supplied with an operating pressurized fluid, and a fifth operating step in which said supporting frame is automatically opened to unload therefrom an ironed cloth article.

* * * * *